US006450829B1

(12) United States Patent
Weisz-Margulescu

(10) Patent No.: US 6,450,829 B1
(45) Date of Patent: Sep. 17, 2002

(54) SNAP-ON PLUG COAXIAL CONNECTOR

(75) Inventor: Adam Weisz-Margulescu, Thornhill (CA)

(73) Assignee: Tyco Electronics Canada, Ltd., Ontario (CA)

( * ) Notice: Subject to any disclaimer, the term of this patent is extended or adjusted under 35 U.S.C. 154(b) by 0 days.

(21) Appl. No.: 09/738,675

(22) Filed: Dec. 15, 2000

(51) Int. Cl.[7] ..... H01R 13/627
(52) U.S. Cl. ..... 439/352; 439/263; 439/675
(58) Field of Search ..... 439/258, 263, 439/352, 578, 675, 731, 687

(56) References Cited

U.S. PATENT DOCUMENTS

| | | | | | |
|---|---|---|---|---|---|
| 2,727,759 | A | * | 12/1955 | Elliott | 337/194 |
| 2,877,437 | A | * | 3/1959 | Flanagan, Jr. | 439/353 |
| 3,435,848 | A | * | 4/1969 | Johnston | 137/614.04 |
| 3,684,321 | A | * | 8/1972 | Hundhausen et al. | 285/316 |
| 3,953,098 | A | * | 4/1976 | Avery et al. | 439/258 |
| 4,008,941 | A | | 2/1977 | Smith | |
| 4,017,139 | A | | 4/1977 | Nelson | |
| 4,374,606 | A | | 2/1983 | Lathrop | |
| 4,412,717 | A | | 11/1983 | Monroe | |
| 4,443,054 | A | * | 4/1984 | Ezawa et al. | 439/263 |
| 4,697,859 | A | * | 10/1987 | Fisher, Jr. | 439/246 |
| 4,919,627 | A | * | 4/1990 | Cable | 439/263 |
| 5,062,808 | A | | 11/1991 | Hosler, Sr. | |
| 5,316,494 | A | | 5/1994 | Flanagan et al. | 439/352 |
| 5,482,477 | A | | 1/1996 | Michael | |
| 5,547,400 | A | * | 8/1996 | Wright | 439/668 |
| 5,561,269 | A | | 10/1996 | Robertson et al. | |
| 5,595,499 | A | | 1/1997 | Zander et al. | |
| 5,601,446 | A | | 2/1997 | Wright | |
| 5,695,357 | A | | 12/1997 | Wright | |
| 5,741,159 | A | | 4/1998 | Wright | |
| 5,816,853 | A | | 10/1998 | Buekers et al. | |
| 5,842,872 | A | | 12/1998 | Hosler, Sr. et al. | |
| 6,036,540 | A | | 3/2000 | Beloritsky | |
| 6,149,460 | A | * | 11/2000 | Straeb et al. | 439/578 |
| 6,287,149 | B1 | * | 9/2001 | Elkhatib et al. | 439/610 |

OTHER PUBLICATIONS

AMP Customer Drawing—C–414948—1996.
AMP Customer Drawing—C–415134—1995.

* cited by examiner

*Primary Examiner*—Tulsidas Patel
*Assistant Examiner*—Thanh-Tam Le

(57) ABSTRACT

A coaxial connector assembly includes a plug connector 2 and a mating jack connector 102. The plug connector 2 is a snap-on or quick connect and quick disconnect style connector. The plug connector 2 includes a shell 10 that can be terminated to a coaxial cable outer shield or braid 114. The shell 10 has deflectable spring fingers 12 formed at its mating end with a radially extending lip 16. A collar 30 surrounds the shell 10. The collar 30 is formed by a two housing components 32 that are preferably identical and can be mated together in surrounding relationship to the shield. Spring beams 34, 34A or elastomeric members 34B engage the peripheral lip to urge the collar 30 and the shell 10 toward a neutral position, even though the collar 30 and the shell 10 are relatively axially shiftable to facilitate mating and unmating.

27 Claims, 5 Drawing Sheets

SNAP-ON PLUG COAXIAL CONNECTOR

BACKGROUND OF THE INVENTION

1. Field of the Invention

This invention is directed to a coaxial connector or connector system that can be employed to interconnect segments of a coaxial cable or an RF transmission cable. The invention is also related to a snap lock or snap-on configuration in which two coaxial connectors are mated by pushing them together without the need to screw one connector to a mating connector.

2. Description of the Prior Art

Coaxial connectors of many types are used to interconnect two coaxial cable segments or to interconnect a coaxial cable to a printed circuit board. Screw threaded connections and BNC style coaxial connectors provide a measure of mechanical security to the interconnection. Snap-on or snap lock connectors, however, provide a simpler means for making such a connection, requiring less mechanical manipulation. When a coaxial cable connection is part of an assembly operation or a larger component, a simple and fast connection has increased significance.

One means of forming a snap-on coaxial connector is to employ a metallic shell that is terminated at one end to the coaxial cable braid or outer conductor and which includes a plurality of spring fingers at the other end. The spring fingers can either encircle a corresponding surface on the mating connector or the spring fingers can fit into a ring on the other connector. Typically, the spring fingers will be deflected during initial mating, but when two coaxial connectors are fully mated, the spring fingers will, in a first or neutral position, fit into a groove, or recess or valley on the connector to which it is mated. A surrounding collar can be used in conjunction with a contact terminal or shell including spring fingers of this type. The collar can be axially shifted relative to the spring fingers so that in a second position, the spring fingers can be deflected during initial mating. After the spring fingers return to the first or neutral position, the collar shifts to a position that will prevent the spring fingers from being deflected out of engagement. To disconnect the two coaxial connectors, the collar must first be shifted to a position allowing the spring fingers to be radially deflected out of engagement with the groove or recess on the other connector. Typically, snap lock or snap-on coaxial connectors of this type employ a coil spring to provide a spring force between the shell and the collar. However, a connector of this type requires the assembly of numerous parts including a collar, a shell, a coil spring, spring washers or stops at either end of the spring, a pin to terminate the center contact and a dielectric to separate pin or stripped inner conductor from the outer shell and the braid to which it will be terminated. The shell and the collar for prior art connectors are also typically fabricated as metal components, with the most common fabrication techniques involving screw machining or die casting operations for the collar and the shell. Finally, some means must be provided for securing the collar to the shell as part of the fabrication assembly. For some coaxial connectors, employing cylindrical collars and shells, a post assembly, metal forming technique is used to attach the collar as part of the overall assembly. One such technique involves the step of rolling over or deforming one end of the collar to trap the coil spring in place. All of these assembly operations add cost to the final product.

Two examples of coaxial connectors employing a cylindrical metal collar and a cylindrical metal shell with deflectable spring fingers are shown in U.S. Pat. Nos. 4,017,139 and 5,316,494. The device shown in U.S. Pat. No. 4,017,139 employs spring fingers to fit within an annular groove on the mating jack connector to form a quick connect and quick disconnect configuration. U.S. Pat. No. 5,316,494 employs a metal collar and shell to mate with another coaxial connector that has external screw threads on a mating jack instead of a single annular groove.

Although these connectors have worked well for their intended applications, there is a need to reduce the cost of manufacture for connectors of this general type. Furthermore the increasing use of coaxial connectors in applications where the connection may be subjected to vibration has revealed another disadvantage with the use of metallic shells and collars for snap-on coaxial connectors. Where a coaxial connector is used to connect electronic equipment in an automobile, vibrations can cause an audible rattle between the metallic shell and collar for conventional snap-on connectors. Since these connectors are quite often used in or adjacent to the passenger compartment where electronic equipment, such as GPS based systems are mounted, this rattle can be objectionable. Because of the manufacturing tolerances that are used to fabricate cylindrical metallic shells and collars of this type it has proven difficult to eliminate this auditory rattle using conventional connectors. The present invention provides a means for simplifying manufacture of snap-on connectors and for eliminating the noise associated with all metal cylindrical coaxial cable assemblies without adversely affecting the electrical or mechanical integrity of the interconnection, while at the same time even further simplifying assembly of a plug coaxial connector to jack coaxial connector in an automobile or other large assembly.

SUMMARY OF THE INVENTION

This invention comprises a first coaxial connector, such as a plug, in which a first terminal, such as a plug shell, includes a deflectable locking member. The locking member engages a mating second terminal on a mating second coaxial connector, such as a jack connector. The first coaxial connector also includes a molded housing, which can function as a collar surrounding the shell. The first terminal is axially movable relative to the molded housing between a first, or neutral, and a second position, The locking member, which can be in the form of split cylindrical spring fingers, is deflectable when the first terminal and the molded housing are in the second relative position. The deflectable member is held in engagement with the second terminal by the molded housing when the first terminal and the molded housing are in the first relative position. The first coaxial connector also includes a spring, in the form of spring beams or an elastomeric member that engages with the first terminal to urge the first terminal and the molded housing toward the first or neutral position.

This coaxial connector can also be described as including a coax terminal shell with a generally cylindrical cross section and an outer collar surrounding the coax terminal shell. The outer collar includes a generally cylindrical inner surfaces on which the coax terminal shell is positioned and a upper and lower relatively noncircular exterior surfaces, which may be part of an overall rectangular shape. The outer collar comprises two separate housing components securable in surrounding relationship to the coax terminal shell in a position to permit relative movement between the coax terminal shell and the outer collar. The collar can be molded or fabricated in a different manner in accordance with the broader aspects of this invention.

This coaxial connector can include a snap lock shell attachable to an outer conductor in a coaxial cable and a collar axially shiftable relative to the shell. The snap lock shell has at least one radially deflectable member located on a mating end of the shell and radially extending lip, spaced from the deflectable member. The radially extending lip is trapped between springs, such as spring beams or elastomeric members, affixed to the collar. These springs generate a force between the shell and the collar for maintaining the shell and the collar in a relatively neutral position. The collar can be molded or fabricated in a different manner in accordance with the broadest aspects of this invention.

DETAILED DESCRIPTION OF THE PREFERRED EMBODIMENTS

Figure 9:
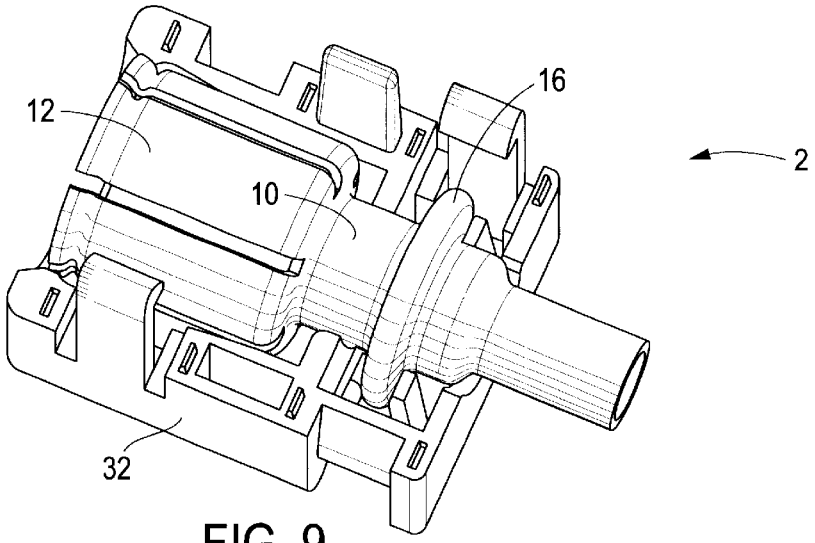
FIG. 9 is a view of a first alternate embodiment of the invention showing a shell contact mounted in one of two collar or housing components.
Figure 10:
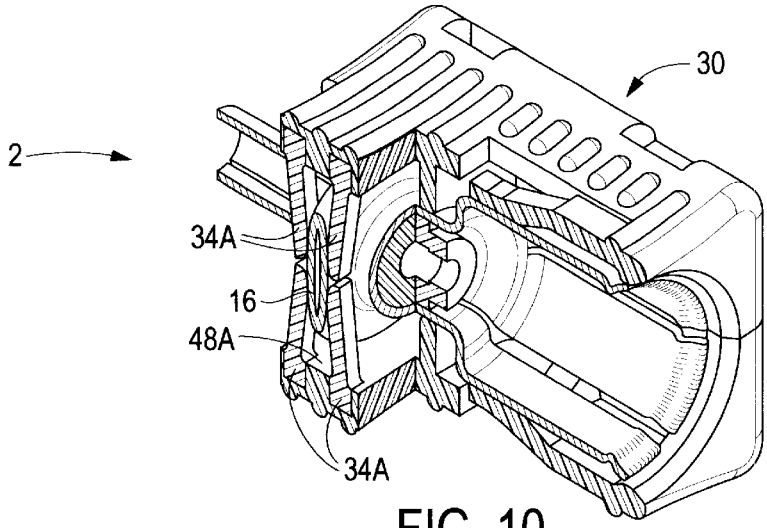
FIG. 10 is an isometric view, partially in section, of the plug connector assembly of the embodiment of FIG. 9.
Figure 11:
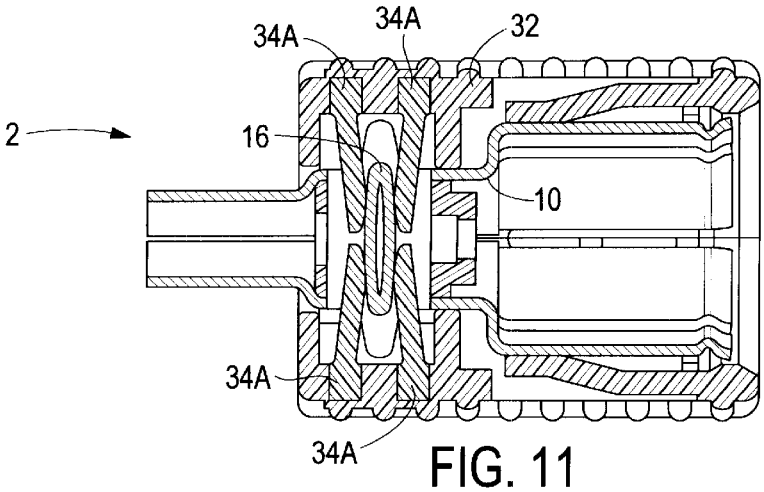
FIG. 11 is a section view of the embodiment shown in FIGS. 9 and 10.
Figure 12:
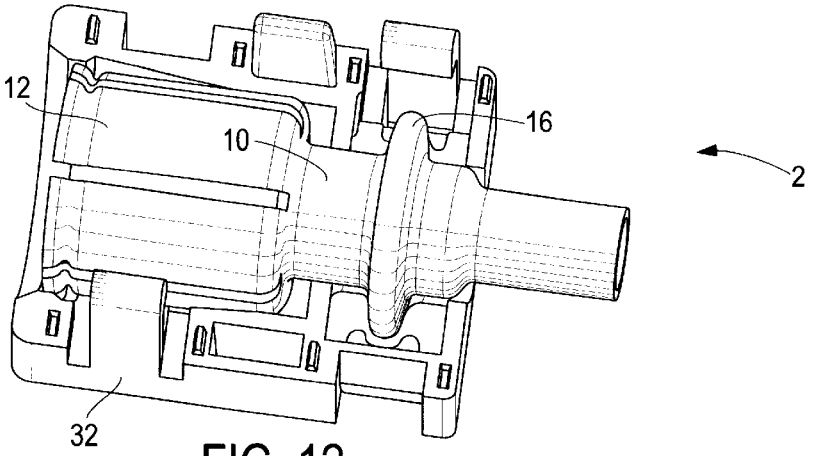
FIG. 12 is a view of a second alternate embodiment of the invention showing the shell contact mounted in one of two collar or housing components.
Figure 13:
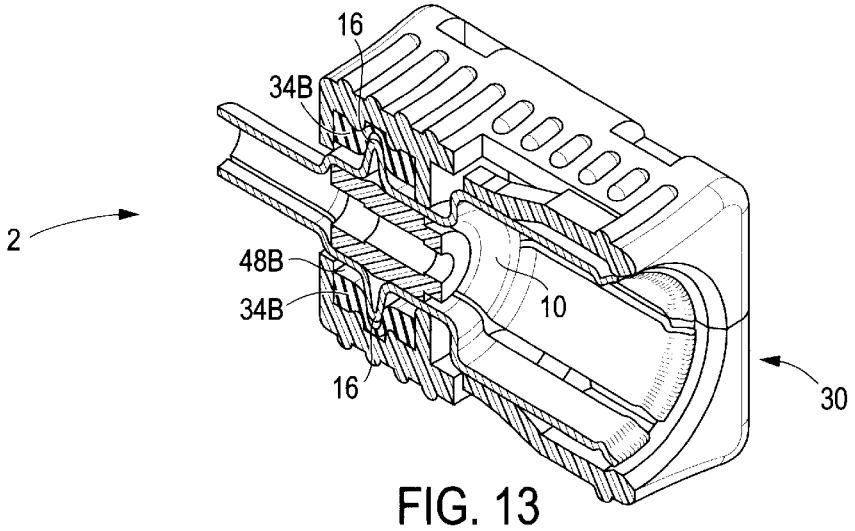
FIG. 13 is a isometric view, partially in section, of the embodiment of FIG. 12.
Figure 14:
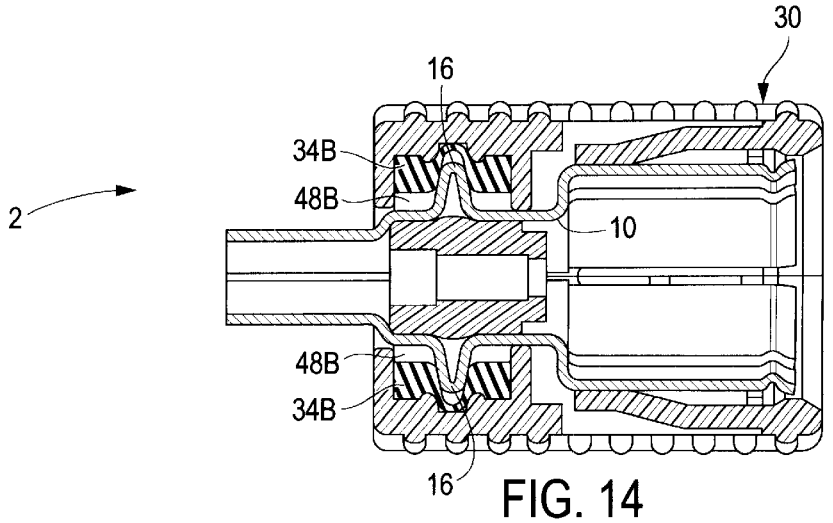
FIG. 14 is a section view of the embodiment of FIG. 12, showing an elastomeric spring element affixed to the collar or outer housing component.

The preferred embodiment of this invention is shown in FIGS. 1–6. One alternate embodiment is shown in FIGS. 9–11, and a second alternate embodiment is shown in FIGS. 12–14. Other alternatives are also discussed, but these embodiments are believed to be sufficiently representative to allow one of ordinary skill in the art to appreciate the details of this invention as well as equivalent structures that can be employed to practice this invention.

Figure 8:
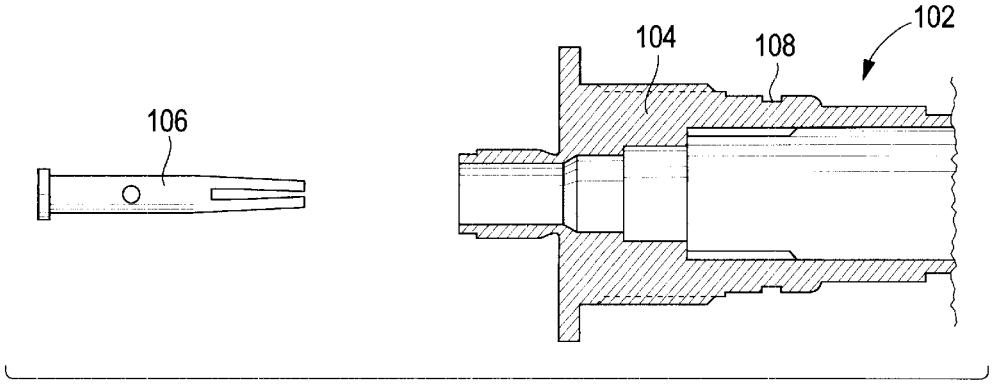
FIG. 8 is a view of a coaxial jack connector with which the plug connector of this invention can be mated.

The snap-on coaxial plug connector 2, shown in FIGS. 1–6 is intended to mate a conventional coaxial jack connector 102, shown in FIG. 8. Each of the plug and jack connectors 2 and 102 can be attached to a stripped end of a coaxial cable 110 having a center conductor 112 and an outer shield or braid 114 in a substantially conventional fashion. In the preferred embodiments, the plug connector 2 includes a plug snap lock shell 10 that can be terminated to the braid 114 of a coaxial cable 110 and a center pin 22 (shown in FIG. 6) that can be terminated to the center coaxial conductor 112. It should be understood that in some alternate applications, the center pin 22 can be eliminated and the center conductor 112 itself can be mated with a jack or receptacle center contact in the mating jack connector 102. The conventional jack connector 102 also includes an outerjack shell 104 that can be terminated to the coaxial cable braid 114, and a center jack or receptacle contact 106 that is terminated to the center conductor. The plug shell 10 can be snapped into engagement with the jack shell 104, which contains a groove 108 into which the plug shell 10 will lock in a manner to be subsequently described in more detail.

Coaxial plug connector 2 has a mating end 4 and a rear end 6. A mating coaxial jack is inserted into a mating cavity 8 on the mating end of the plug connector 2, and a stripped end of a coaxial cable 110 enters the plug connector 2 through the rear end 6. The coaxial plug connector 2 is an assembly including a plug snap lock shell 10, a pin 22, a dielectric sleeve 24 and a molded collar or housing 30. The molded collar or housing 30 is formed by two identical or hermaphroditic housing components 32 that can be snapped together in surrounding relationship to the snap lock or snap on shell 10. The shell 10 in turn surrounds the pin 22 which is separated from the shell 10 by a cylindrical dielectric sleeve 24.

In this preferred embodiment, the shell 10 comprises a one piece zinc die cast member. It should be understood, however, that the shell 10 could be screw machined and could consist of a die cast and a screw machined portion that are secured to each other. In some applications, the shell 10 could also be stamped and formed. Shell 10 is generally cylindrical and has deflectable locking members or spring fingers 12 formed between the mid section of shell 10 and the mating cavity 4. These deflectable locking members 12 are formed by slots extending axially from a mating end 8 of the shell 10. Each of the six deflectable locking members 12 has a locking ridge 14 protruding radially inwardly adjacent to the tip of the corresponding locking finger 12. These locking ridges 14 are dimensioned to fit within the locking groove 108 on the mating jack connector 102. The locking fingers 12 are sufficiently flexible that they can all be deflected radially outward when mated with the jack connector 102 before the locking ridges 14 are positioned in alignment with the groove 108. The deflectable locking fingers 12 can also be deflected when a sufficient axial force is applied to disengage the locking ridges 14 from the groove 108, unless the collar or housing 30 is in position to prevent outward movement of the deflectable members 12.

Just to the rear of the cylindrical deflectable members 12 is a cylindrical section 20 that has an outer diameter that is smaller than the outer diameter of the cylindrical section formed by the array of deflectable spring fingers 12. This section 20 serves as a bearing surface supporting the shell 10 in the outer collar 30 and also serves to retain the dielectric 24 in place, and this section 20 can be press fit, crimped or staked around the dielectric 24. A circular lip 16 extends radially outward from the central bearing section 20 at its rear. In the preferred embodiment, the outer diameter of this radially extending peripheral lip 16 is approximately equal to the outer diameter of the cylindrical section formed by deflectable locking springs 12. A crimping mandrel 18 of generally conventional configuration is located at the rear end of the shell 10, and when used with an outer ferrule of conventional construction (not shown) the stripped braid or outer conductive sheath 114 on an end of a stripped coaxial cable 110 can be terminated between the ferrule and the crimping mandrel 18.

Coaxial plug connector 2 also includes an outer collar or housing 30 that is positioned in surrounding relation to the shell 10 by latching two identical or hermaphroditic molding housing components 32 together. The collar 30 and the shell 10 are axially movable relative to each other. During mating of the coaxial plug connector 2 to a coaxial jack connector 102 the shell 10 first retracts or moves axially rearward relative to the collar 30, and when the shell latching ridges 14 snap into the jack groove 108 it is possible to feel the click and the jack is then released. The collar 30 is then free to move back to its locking position preventing outward deflection of the deflectable spring fingers 12 out of groove 108. In this manner the two coaxial connectors are maintained in their mated configuration. To disengage the two coaxial connectors, the collar 30 is shifted axially relative to the shell 10 so that the deflectable spring fingers will be cammed radially outward and out of groove 108 by the application of sufficient axial force.

The collar housing components 32 each comprise one piece injection molded members formed of a material such as acetal. Two of these components 32 can be positioned in opposing relationship and then snapped together to form the axially shiftable collar 30, which surrounds the shell 10. Each housing component 32 includes two molded latch arms 40 that will engage opposed latching surfaces 42 on the other component 32 when snapped together. Each housing component also includes an alignment projection 44 that fits within an aligned and opposing alignment recess 46 when the two collar halves are snapped together. Of course other latching and alignment means could be employed instead of the molded members and surfaces located on the housing components 32. For example, the two housing halves could be screwed together. It is also not essential that the two components 32 be identical or hermaphroditic, although the use of only one molded shape does have inherent and apparent manufacturing advantages.

Figure 1:
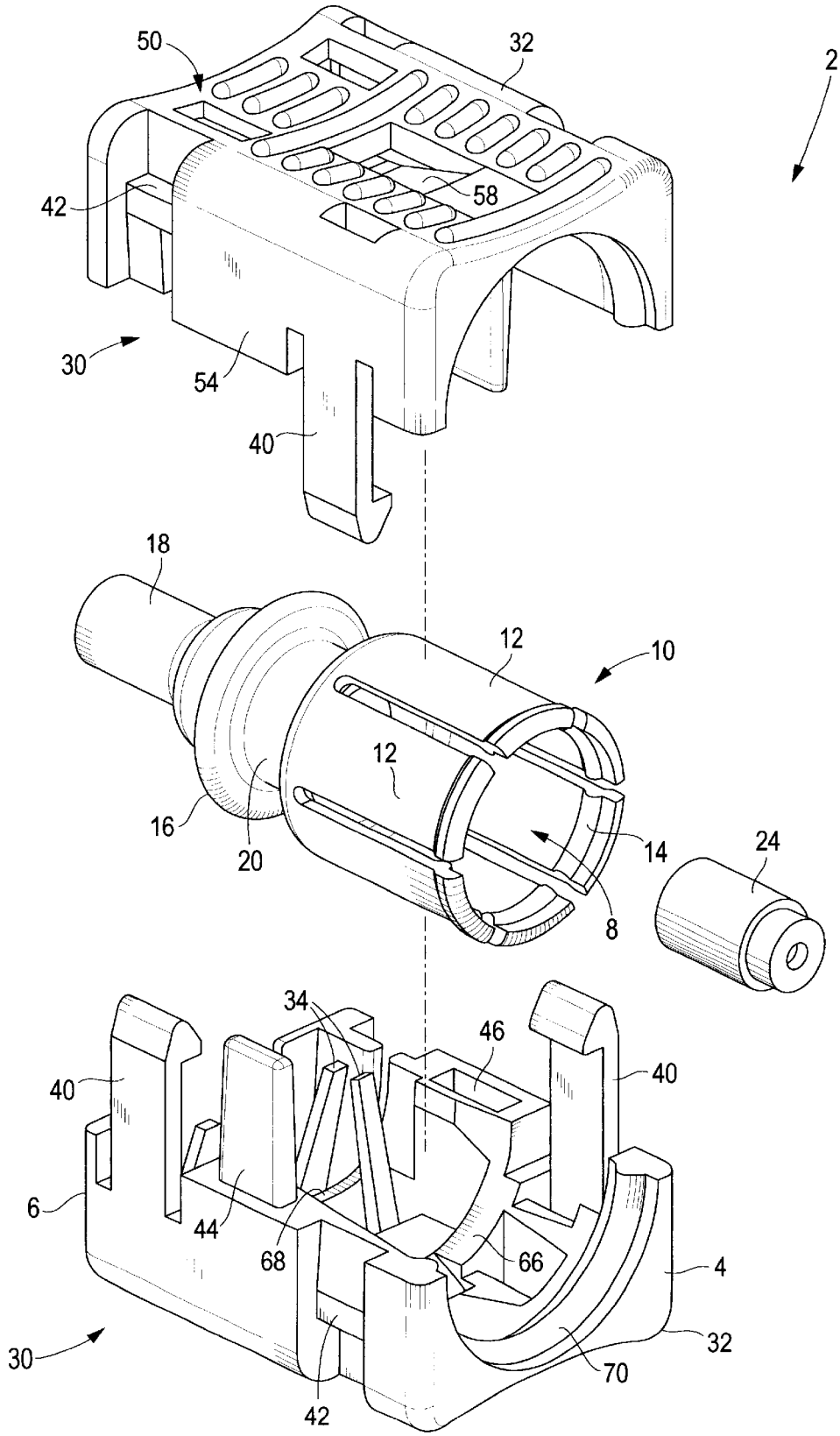
FIG. 1 is an exploded three dimensional view of the preferred embodiment of plug coaxial connector.
Figure 2:
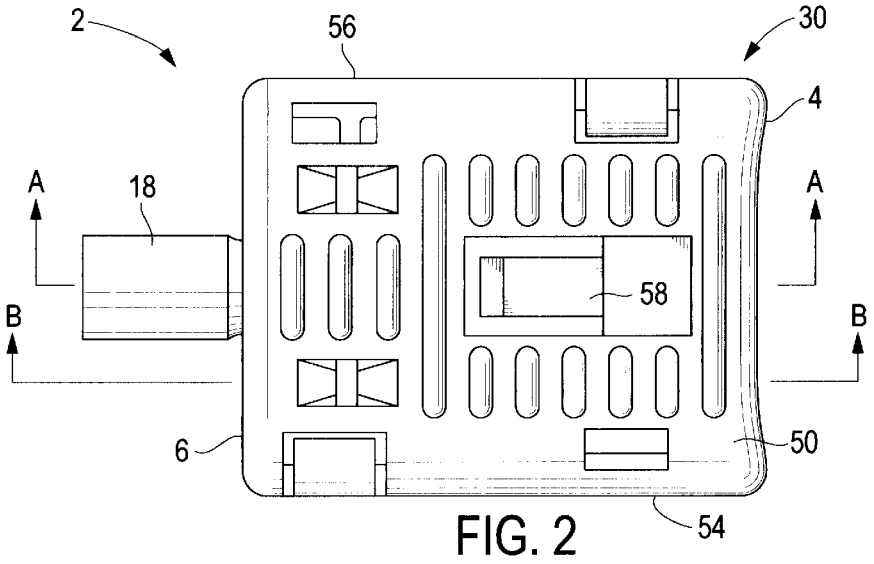
FIG. 2 is a top view of the plug coaxial connector
Figure 3:
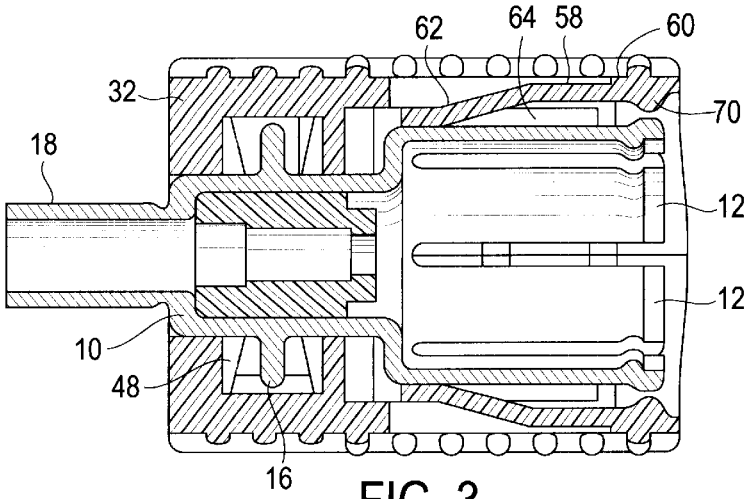
FIG. 3 is a section view taken along section line A—A in FIG. 2.
Figure 4:
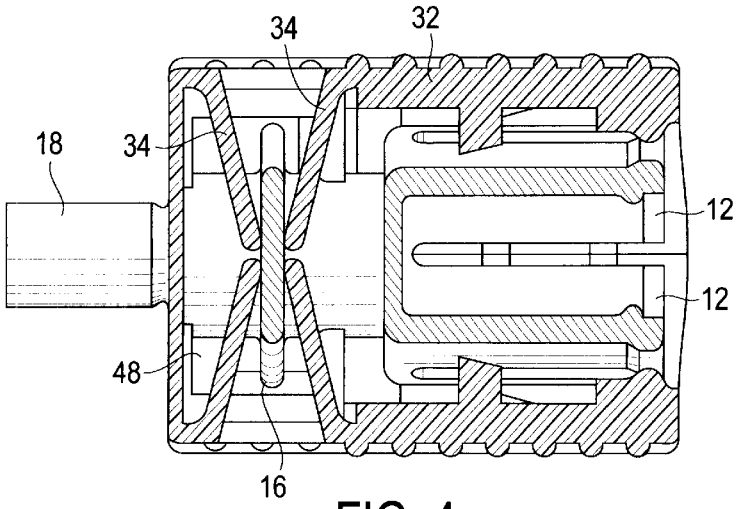
FIG. 4 is a section view taken along section lines B—B in FIG. 2.
Figure 5:
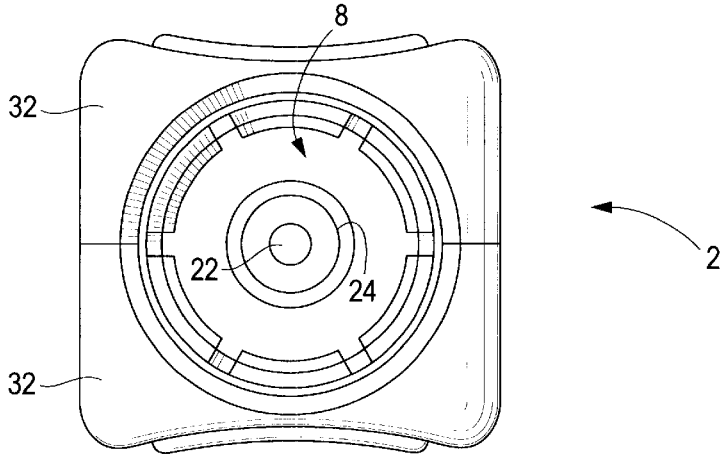
FIG. 5 is a view of the mating end of the plug connector.
Figure 6:
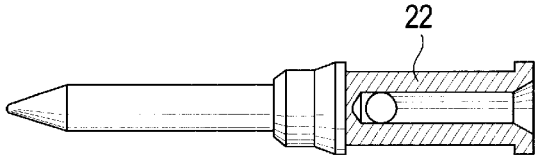
FIG. 6 is a view of a pin contact that can be used in this plug connector and can be attached to the center conductor in a coaxial cable.
Figure 7:
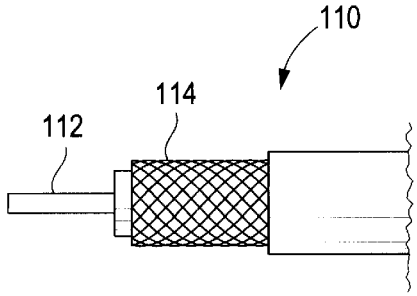
FIG. 7 is a view of the stripped end of a coaxial cable when prepared for termination to the plug connector of this invention.

The molded collar 30 has a generally rectangular configuration with opposite top surface 50 and bottom surface having a noncircular configuration. In fact, the top and bottom surfaces each have oppositely facing curved surfaces that allow them to be gripped easily by the thumb and finger of an installer. Opposite side surfaces 54, 56 along which molded latch arms 40 extend, form the rest of the generally rectangular external configuration of the molded collar 30. The cylindrical shell 10 is supported in the molded collar housing 30 by a curved front bearing surface 66 and a rear bearing surface 68 which support the shell 10 on opposite sides of the radial lip 16, which is received within a pocket 48 in which the peripheral lip 16 will reside. The deflectable cylindrical locking section or locking fingers 12 are centered within the mating cavity 8, as best seen in FIG. 5, formed at the plug connector mating end 4 by the two latched collar housing components 32 by a molded centering arm 58 extending from each housing half 32. This centering arm 58 engages the outer surface of at least one aligned deflectable spring locking finger 12. In the preferred embodiment, this centering arm 58 comprises a molded cantilever extending from its base 60 where it is joined to the rest of the corresponding housing component 32 of which it forms an integral part. A tip section 62 of this centering arm is spaced radially inward relative to the centering arm base 60 so that only the tip section 62 engages the opposed deflectable spring finger 12. In this position the centering arms, of which there are a plurality surrounding the shell, comprise anti-vibration means, preventing vibration and rattle of the shell 10 and the spring locking fingers 12, relative to the mating connector, when the connector is used in an automobile or other assembly that might otherwise transmit these vibrations to the connector assembly. The centering arm 58 extends rearwardly from a base 60 that is more closely adjacent the mating end of the collar and a recess or clearance section is formed between the tip section 62 of arm 58 and a circular rib 70 formed on the inside of the mating end of the collar 30. Circular rib 70 is located in opposition to the tips of the deflectable spring fingers 12 when the collar 30 and the shell 10 are in the neutral position. In that position the opposed ribs 70 prevent outward deflection of the deflectable spring fingers 12. A clearance recess or area 64 is formed between the ribs 70 and the tip sections 62 of centering arms 58 so that the deflectable spring fingers can flex outwardly when their tips are axially aligned with this clearance area 64. Although the tip section 62 of the centering arm remains in contact with the shell 10, the metal shell can move relative to the portion of the molded centering arm with which it is in contact without excessive friction and perhaps more importantly without any vibration or audible noise.

Although relative axial movement is possible between the collar 30 and the shell 10, these two members are held in a neutral position in the absence of application of an external axial force. In the preferred embodiment of FIGS. 1-6, a spring force is exerted between the shell 10 and the collar 30 by molded collar spring beams 34 when the shell 10 or collar 30 is moved from its neutral position. The molded collar spring beams 34 are part of the one-piece housing component 32 and comprise integrally molded extensions of the molded housing component 32. In this first embodiment two pairs of opposed collar spring beams 34 are located in the pocket 48, and each pair is offset from a central plane extending generally parallel to the side housing surfaces 54, 56. Each spring beam 34 extends radially inwardly from a base to a beam distal end. Since each beam is slanted, the distal ends are closer together than the beam bases. In the preferred embodiment, each spring beam 34 will thus engage the peripheral lip 16 only at its distal end and only over a small area, which can be referred to as a point contact. Even when the spring beam 34 is deflected, the beam 34 still engages the peripheral lip 16 at its distal end reducing the force exerted by the spring beam 34 as it is deflected to acceptable value. The radial lip 16 fits between the distal ends of beams 34 when the shell 10 is positioned within the collar 30, and each opposed beam 34 exerts a force that tends to keep the shell 10 in a neutral position relative to the collar housing 30. Since each collar housing component has two pairs or four molded spring beams 34, there are a total of eight spring beams 34 tending to keep the shell 10 in a neutral position relative to the collar. Each pair of spring beams 34 is aligned with an opposed pair of spring beams extending inwardly on an opposed collar housing component 32. The spring beams 34 thus tend to engage the radial lip 16 in positions offset from the center of the cylindrical shell 10. In other words, each spring beam 34 would engage the lip 16 along a chord spaced from a plane extending between the pairs of spring beams 34 in the same housing component 32. When the collar 30 is retracted relative to the shell 10, four spring beams 34 on one side of the peripheral lip 16 will exert a restoring force between the peripheral lip 16 and the collar 30. When the shell 10 is retracted relative to the collar 30, the four spring beams 34 on the other side of the radial lip 16 will exert a restoring force in the opposite direction.

The integrally molded spring beams 34 are not the only means for imparting a spring force between the shell 10 and the collar 30. FIGS. 9–11 show a first alternate embodiment in which separate springs 34A are fabricated from a spring material, such as Hytrel®, a polyether/polyester block copolymer manufactured by DuPont. These separate plastic spring members could also be formed as part of a two shot molding operation in which a portion of the mold is shifted, after the main housing is first shot, opening a new mold cavity into which the more flexible material could be injected. A material of this type is more resilient and has better spring properties than a standard material that would be used to mold the remainder of the collar or housing 30. The separate springs 34A would otherwise have the same or similar configuration as the integrally molded springs 34 shown in the embodiment of FIGS. 1–6. However, these separate springs could be inserted into channels in the pockets 48A formed when the collar housing component 32 is injection molded. Alternatively the springs 34A could be insert molded into the collar housing component 32. With the exception of the separate springs 34A and the spring pocket 48A, the remainder of the collar housing component 32 would remain identical to the configuration shown in FIGS. 1–6 and the same reference numbers have been employed for each embodiment.

A second alternate embodiment is shown in FIGS. 12–14. This embodiment employs an elastomeric or rubber spring 34B in which elastomeric material is located on both sides of the peripheral lip 16. Suitable elastomeric or flexible materials could include silicone or neoprene, among others. The peripheral lip 16 fits within a groove formed in the elastomeric spring 34B, and in the preferred embodiment an aligned groove in formed in the plastic housing forming the pocket 48B as shown in FIGS. 13 and 14. Although separate elastomeric springs 34B would be used in the two housing components 32, only a single elastomeric spring member 34B need to be used in each housing component. In other words, the spring member 34B can have an arcuate shape so that it engages a continuous section of the peripheral lip 16, and separate spring beams, such as that shown in the other embodiments need not be employed. Although the elastomeric springs 34B can be snap fit into the pocket 48B, after the housing component 32 is molded, it is also possible to employ a two stage molding process in which the housing component 32 is first molded from a first material, and the elastomeric material is then injected with the previously inserted molded body serving as one surface of the reconfigured mold as part of a two shot molding operation. Although this embodiment employs a single elastomeric spring 34B in each housing component pocket 48B, it would also be possible to insert separate elastomeric block on opposite sides of the peripheral lip 16, although this would require an additional manufacturing step. Again since only the elastomeric spring 34B, and the spring pocket 48B differs from the other representative embodiments shown herein, the same reference numbers have been used for other elements.

The embodiments depicted in FIGS. 1–14 are believed to be fully representational of the basic elements of this invention. However, other equivalent structures that would be apparent to one of ordinary skill in the art could still be employed in implementing this invention. For example, a coil spring Could be employed with a molded housing, and even though this coil spring would only implement the broader aspects of this invention, such an embodiment would still achieve some of the objects of this invention. Another version could employ a wave spring n the form of a disk having radially extending undulations, that when compressed exert a restorative or spring force. Such a disk could be insert molded into the molded housing. The representative embodiments depicted herein show only an inline version of a receptacle connector plug. The same molded collar housing assembly 30, including the two molded housing components 32, could also be used in a right angle coaxial plug that would include the same elements of the invention as shown in the representative embodiments. Another embodiment incorporating the essential elements of this invention could employ a collar and shell assembly in a coaxial jack connector in which a female contact, and not a pin, were to be terminated to the center conductor of the coaxial cable. A coaxial connector including the basic elements of this invention could be connected to a mating coaxial connector that is terminated either to another coaxial cable segment or to a board mounted RF or coaxial type mating connector.

Although the preferred embodiments of this invention are used with a connector for connecting a single coaxial, multiple shell contact terminals could be mounted in a single molded collar housing to terminate and connect a plurality of separate coaxial lines. It should therefore be apparent that the invention as depicted in the representative embodiments is defined by the following claims and is not limited to the explicit implementation of the invention as depicted herein.

I claim:

1. A coaxial connector comprising a female component having a movable first terminal including a deflectable locking member encased in a molded stationary housing; a male component having a second terminal, said male component being adapted for insertion into said deflectable locking member of said female component, wherein upon insertion of said male component into said deflectable locking member, the first terminal is axially moved to a retracted position within said housing from a first position which prevents deflection of said locking member, and thus prevents insertion and removal of said male component when engaged therein, to said retracted position which permits deflection of said locking member, and thus permits insertion and removal of said male component, and wherein the female component further comprises spring means for biasing the first terminal toward the first position.

2. The coaxial connector of claim 1 wherein the female component comprises a plug connector and the first terminal comprises a plug terminal, and wherein the male component comprises a coaxial jack connector which is matable with said plug connector.

3. The coaxial connector of claim 2 wherein the molded housing comprises two matable housing components which secure together to envelop the first terminal.

4. The coaxial connector of claim 3 wherein the two housing components are identical forming hermaphroditic housing components.

5. The coaxial connector of claim 1 wherein the molded housing includes at least one inwardly projecting arm engaging the deflectable locking member to maintain the deflectable locking member in a generally central location relative to the housing and thus reduce vibration of such member relative to the molded housing.

6. The coaxial connector of claim 1 wherein the spring means extends from the molded housing member and engages a peripheral lip on the first terminal.

7. The coaxial connector of claim 6 wherein the spring means comprises at least one molded spring beam comprising a molded extension of the molded housing extending inwardly toward the first terminal.

8. The coaxial connector of claim 6 wherein the spring means comprises at least one separate member extending between the molded housing and the peripheral lip.

9. The coaxial connector of claim 6 wherein the spring means comprises an elastomeric member joined to the molded housing as part of a two stage molding operation.

10. A coaxial connector comprising a coax terminal shell having a generally cylindrical cross section and an outer collar surrounding the coax terminal shell, the outer collar having a generally cylindrical inner surfaces on which the coax terminal shell is positioned, the outer collar further comprising two separate housing components securable in surrounding relationship to the coax terminal shell in a position to permit movement of the coax terminal shell to a retracted position within the outer collar, wherein the outer collar has a generally rectangular outer periphery.

11. The coaxial connector of claim 10 wherein the two separate housing components are securable in surrounding relationship to only a single coax terminal shell.

12. The coaxial connector of claim 10 wherein the two separate housing components comprise molded members.

13. The coaxial connector of claim 12, wherein the two separate housing components are latched together when in surrounding relationship to the coax terminal shell.

14. The coaxial connector of claim 12 wherein at least one housing component includes an inwardly projecting molded spring beam engaging the coax terminal shell to urge the coax terminal shell relative to the at least one housing component toward a mating end of the coaxial connector.

15. The coaxial connector of claim 14 wherein each housing component includes at least one pair of inwardly projecting molded spring beams, the spring beams forming each pair being slanted toward each other so that the spring beams forming a pair are more widely spaced adjacent where each beam is joined to the outer collar than adjacent opposed distal ends of the spring beams forming a pair of spring beams.

16. The coaxial connector of claim 12 wherein the two separate molded housing components comprise identical hermaphroditic members.

17. The coaxial connector of claim 12 wherein the housing components each include an inwardly projecting arm engaging the coax terminal to center the coax terminal shell relative to the outer collar.

18. The coaxial connector of claim 10 further comprising a pin held in a dielectric sleeve located between the pin and the coax terminal shell.

19. A coaxial connector comprising a snap lock shell attachable to an outer conductor in a coaxial cable and a collar axially shiftable relative to the shell, the snap lock shell including at least one radially deflectable member located on a mating end of the shell and radially extending lip, spaced from the deflectable member, the radially extending lip being trapped between spring means affixed to the collar, the spring means generating a force between the shell and the collar for maintaining the shell and the collar in a relatively neutral position.

20. The coaxial connector of claim 19 wherein the lip has an outer radial dimension at least approximately the same as an outer radial dimension of the at least one deflectable member.

21. The coaxial connector of claim 19 wherein the at least one deflectable member includes an inwardly extending ridge, the ridge comprising means for snap locking the shell to a mating coaxial jack.

22. The coaxial connector of claim 19 wherein the shell includes a crimping mandrel comprising means for attaching the shell to the outer conductor in the coaxial cable, the radial lip being located between the mandrel and the at least one deflectable member.

23. The coaxial connector of claim 19 wherein the spring means engage the lip on opposite sides of the shell.

24. A coaxial connector, matable with a mating coaxial connector, in which the coaxial connector includes a resilient metallic shell matable with a mating metallic member in the mating coaxial connector, to connect outer conductors on coaxial lines attached to the coaxial connector and the mating coaxial connector; the coaxial connector including a collar surrounding the resilient metallic shell with at least one inwardly projecting anti-vibration arm engaging the metallic shell to comprise means for damping vibration of the resilient metallic shell and to reduce rattle and noise due to such vibrations, said collar comprising two matable, identically formed hermaphroditic components that snap together to envelop the metallic shell.

25. The coaxial connector of claim 24 wherein the collar comprises a molded member.

26. The coaxial connector of claim 25 wherein the anti-vibration arm comprises an extension of the molded member.

27. The coaxial connector of claim 26 wherein the collar comprises a two-part housing, each part of the housing including at least one anti-vibration arm.

* * * * *